United States Patent [19]

Hill

[11] Patent Number: 4,630,816

[45] Date of Patent: Dec. 23, 1986

[54] JOGGING APPARATUS

[75] Inventor: Charles C. Hill, Del Mar, Calif.

[73] Assignee: James Virgil Watters, San Diego, Calif.

[21] Appl. No.: 590,541

[22] Filed: Mar. 19, 1984

Related U.S. Application Data

[63] Continuation of Ser. No. 304,804, Sep. 23, 1981, abandoned.

[51] Int. Cl.[4] ..... A63B 23/04; A63B 5/18; A47B 3/00

[52] U.S. Cl. ..... 272/70; 272/65; 5/233; 108/127

[58] Field of Search ..... 272/65, 66, 70, 130, 272/DIG. 9, 1 B; 182/137, 138, 139, 140; 5/196, 197, 417, 420, 440, 179, 180, 312; 108/127, 129, 160; 248/166, 168, 188, 188.6, 439

[56] References Cited

U.S. PATENT DOCUMENTS

| | | | |
|---|---|---|---|
| 1,995,260 | 3/1935 | Flint | 248/188.6 |
| 2,216,818 | 10/1940 | Kuhlman | 182/139 UX |
| 2,324,970 | 7/1943 | Woolley | 272/65 |
| 2,660,497 | 11/1953 | Norquist | 108/127 |
| 2,934,989 | 5/1960 | Belli et al. | 84/411 X |
| 2,975,491 | 3/1961 | Paul et al. | 16/286 X |
| 2,979,981 | 4/1961 | Ludwig | 84/411 |
| 3,095,947 | 7/1963 | Beaulaurier | 182/139 |
| 3,197,789 | 8/1965 | Ashkouti et al. | 5/197 X |
| 3,459,093 | 8/1969 | Nishiura et al. | 84/411 |
| 4,284,271 | 8/1981 | Pettit et al. | 272/65 X |
| 4,330,124 | 5/1982 | Vettorello | 84/418 X |

FOREIGN PATENT DOCUMENTS

| | | | |
|---|---|---|---|
| 1099001 | 3/1955 | France | 108/127 |
| 281555 | 12/1964 | Netherlands | 5/197 |

OTHER PUBLICATIONS

"Mini-Tramp", Trampolines by Nissen, 1976 Catalog, p. 11.

*Primary Examiner*—Richard J. Johnson

*Attorney, Agent, or Firm*—Barnes, Kisselle, Raisch, Choate, Whittemore & Hulbert

[57] ABSTRACT

A jogging apparatus comprising a tubular frame, an elastomeric member bonded to the frame and a mat bonded to the elastomeric member when the elastomeric member is preloaded radially inwardly so that when the load on the elastomeric member is released, the mat is tightly stretched on the frame to provide the jogging surface. Circumferentially spaced legs are pivoted to the inner surface of the frame and which, in operative position, have portions extending radially outwardly and downwardly and which are foldable inwardly within the plane of the jogging apparatus. The legs are mounted by a construction which tends to urge the legs yieldingly outwardly when they are extended and tends to urge the legs yieldingly inwardly when they are folded inwardly.

24 Claims, 8 Drawing Figures

FIG. 4
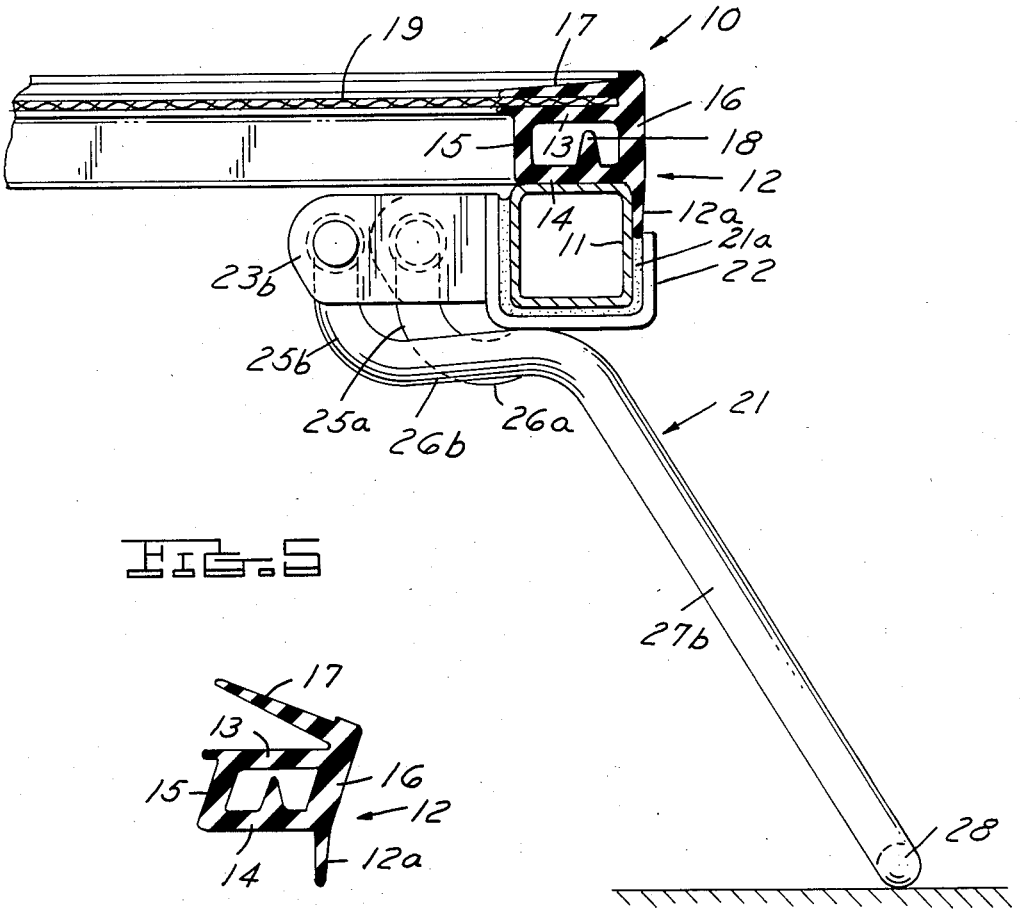
FIG. 5
FIG. 7
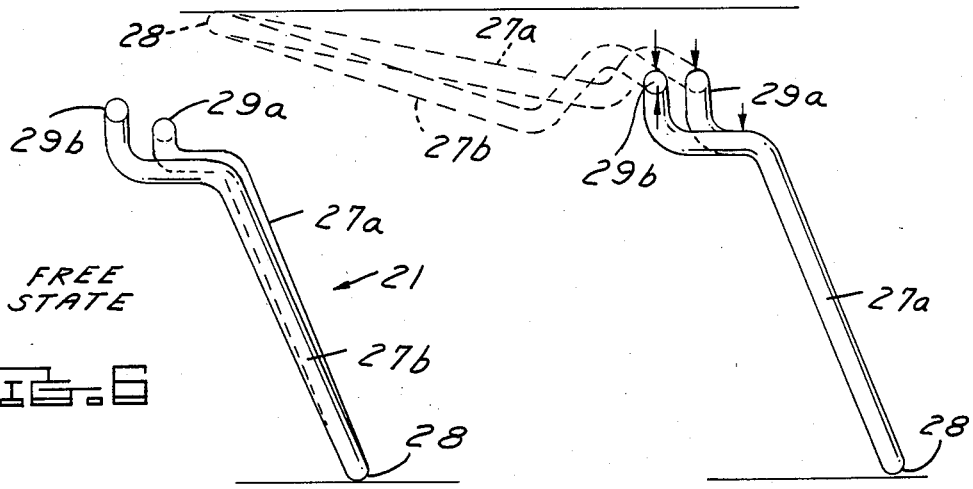
FIG. 6

JOGGING APPARATUS

This application is a continuation of application Ser. No. 304,804, filed Sept. 23, 1981, and now abandoned.

This invention relates to jogging apparatus and particularly to portable jogging apparatus.

BACKGROUND AND SUMMARY OF THE INVENTION

It has heretofore been proposed that exercise or jogging apparatus be provided which permits the person exercising to run in place. Generally such apparatus has comprised a frame and a mat or other resilient surface mounted directly to the frame or mounted on the frame by elastic cords or tension springs, much in the manner of trampolines. It has also heretofore been suggested that a jogging surface can be provided by a solid elastomeric body. Both types of such apparatus are typified in U.S. Pat. Nos. 3,004,623, 3,892,403, 4,037,834, 3,634,895 and 3,641,601.

Among the objectives of the present invention are to provide an approved jogging apparatus which includes a tightly tensioned mat that has a larger usable area within the frame, more uniformly distributes the load to the frame, is lower in cost, can have controlled energy absorption by the proper selection of materials, is safer in that it does not utilize open spaces between the mat and the frame, has a sturdy, safe supporting structure and is foldable for shipment and storage.

In accordance with the invention, the jogging apparatus includes a frame having an elastomeric body bonded thereto and the mat bonded to the body such that the elastomeric body is under shear and holds the mat tightly stretched in biaxial tension. The jogging apparatus further includes legs that are pivoted to the frame and are normally extended outwardly and downwardly but can be folded inwardly within the confines of the frame. The legs are mounted by a construction which tends to urge the legs yieldingly outwardly when they are extended and tends to urge the legs yieldingly inwardly when they are folded inwardly.

DESCRIPTION OF THE DRAWINGS

FIG. 4 is a fragmentary sectional view taken along the line 4—4 in FIG. 3.

FIG. 5 is a cross sectional view of a portion of an elastomeric body used in the jogging apparatus prior to assembly.

FIG. 6 is a side elevational view of a leg of the jogging apparatus prior to assembly.

FIG. 7 is a partly diagrammatic view of the leg in extended and folded position.

DESCRIPTION

Figure 1:
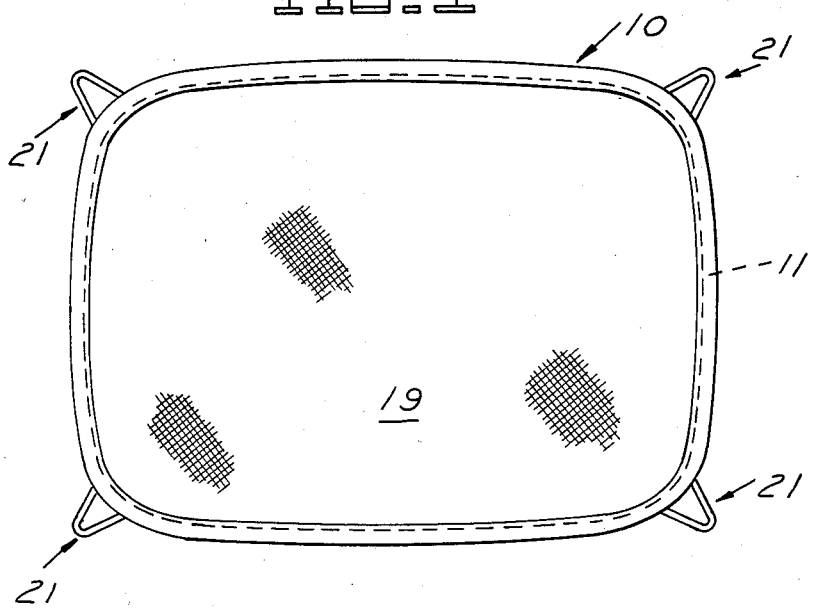
FIG. 1 is a plan view of the jogging apparatus embodying the invention.
Figure 2:
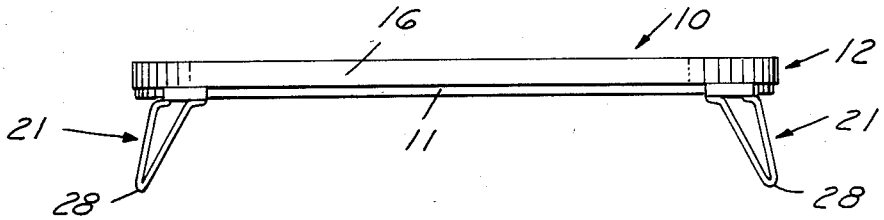
FIG. 2 is a side elevational view of the same.

Referring to FIGS. 1–4, the jogging apparatus 10 embodying the invention comprises a tubular frame 11 that preferably has a long or major axis and a short or minor axis. The frame 11 in its preferred form is generally rectangular and preferably comprises an ellipse having arcuate corners and curved sides blending in with the arcuate corners in the manner of a fifth order super ellipse.

As shown in FIG. 4, the tubular frame 11 is square in cross section and a elastomeric body 12 is bonded to the top surface and outside surface thereof. The elastomeric body 12 is hollow in cross section and preferably includes a top wall 13, a bottom wall 14 and inner and outer side walls 15, 16. The elastomeric body also includes a lip 17 that extends upwardly and inwardly from the area of juncture of the outer side wall 16 and top wall 13 and an upwardly extending annular bead 18 that extends upwardly from the bottom wall 14 between side walls 15, 16 (FIG. 5). The body 12 preferably extends around the entire top surface of the frame and preferably comprises one piece with its ends abutting to form a continuous annular body. Alternatively, body 12 may comprise a plurality of pieces in abutting or spaced relation to one another.

In its unloaded or undeformed state, the elastomeric body assumes the configuration shown in FIG. 5 so that the inner wall 15 and the outer wall 16 extend upwardly and outwardly and the lip 17 extends upwardly and inwardly. The body 12 further includes a vertical lip **12*a* extending downwardly from the area of juncture of the outer side wall 16 and bottom wall 14**.

A mat 19 of flexible material is adhered to the top wall 13 of the elastomeric body and loads the elastomeric body in shear as shown in FIG. 4 such that the inner wall 15 and the outer wall 16 are generally vertical. As a result, the mat is stretched tightly.

The elastomeric body 12 is made of a resilient elastic material such as rubber or urethane having a high tear resistance and is preferably extruded. A satisfactory material has a durometer of 40–60 on the A scale. The mat 19 may comprise a polypropylene woven fabric. Suitable adhesives comprise urethane or other well-known adhesives.

In assembly of the jogging apparatus, the body 12 is bonded to the frame 11. More specifically, the bottom wall 14 is bonded to the top surface of frame 11 and the lip **12*a* is bonded to the outer surface of frame 11. The body 12 is then loaded or deformed radially inwardly, as by a band or clamp, bringing inner and outer side walls 15, 16 into vertical position. The periphery of mat 19 is then inserted between top wall 13 and lip 17, the lip is forced downwardly on the mat and the mat is bonded to the body 12. After the bonding, the load on the body 12 is released and the mat is thereby stretched in biaxial tension due to the tendency of the body 12 to return to its original configuration. The body 12** thus is placed under shear.

In accordance with the invention, the structure provides a large exercise area in a simple low cost manner without having space between the jogging surface and the frame thereby making the jogging apparatus safer.

Figure 3:
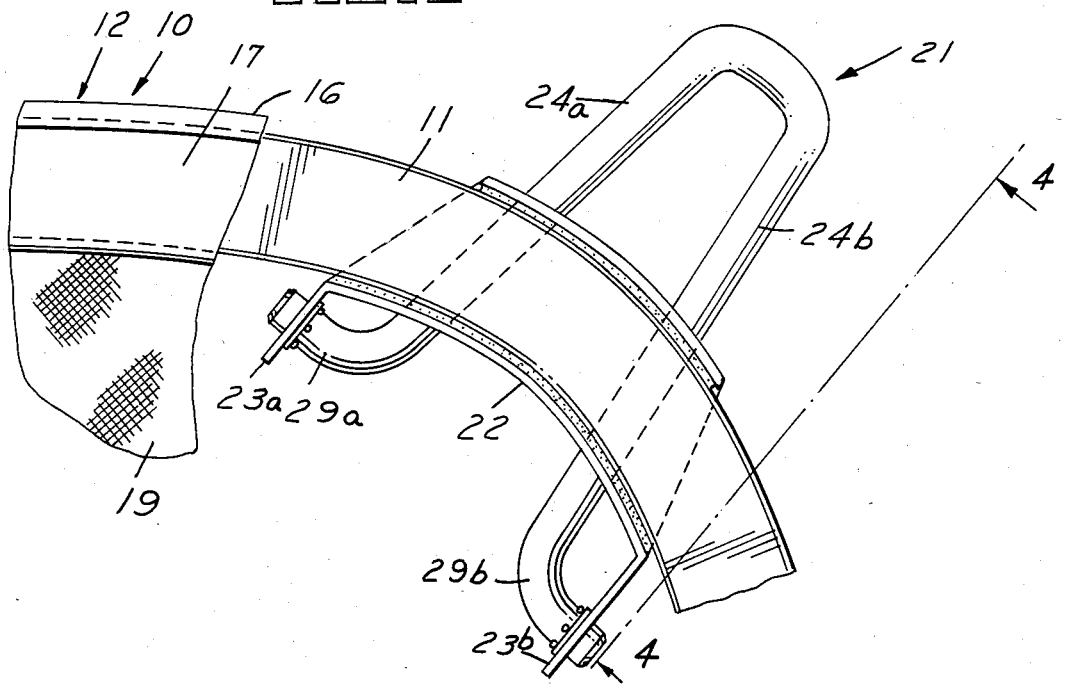
FIG. 3 is a fragmentary part sectional plan view on an enlarged scale of a portion of the jogging apparatus shown in FIG. 1.

Referring to FIGS. 3–5, legs 21 are provided at circumferentially spaced points on the frame, preferably at the arcuate corners, and are supported on the frame by brackets 22 which are generally U-shaped. A layer **21*a* of elastomeric material is positioned between each bracket and the bottom and inner and outer side walls of the frame 11** and is bonded thereto as by adhesive.

Each bracket 22 includes radially inwardly extending ears **23*a*, 23*b*. Each leg 21 is preferably made of a spring tempered metal rod that is bent in a U shape defining legs 24*a*, 24*b* which in the extended position have vertical portions 25*a*, 25*b*, horizontal portions 26*a*, 26*b* engaging the undersurface of the bracket 22 on the frame, and a downwardly and outwardly inclined portion 27***a*, 27*b* joined to a ground engaging portion 28. The legs 24*a*, 24*b* further include outwardly extending horizontal portions 29*a*, 29*b* that are pivoted to ears 23*a*, 23*b*.

As shown in FIG. 3, the axes of the openings in ears 23*a*, 23*b* through which the portions 29*a*, 29*b* extend lie in the same plane parallel to the plane of mat 19. In addition, the axis of the opening in bracket 23*b* is displaced radially inwardly of the axis of the opening in bracket 23*a* (FIGS. 3, 4). Portion 26*a* is shorter than portion 26*b* and portion 27*a* is longer than portion 27*b* so that in the untensioned state the portion 29*b* is displaced laterally or radially inwardly and is lower or not in the same horizontal plane as viewed in elevation (FIG. 6). As a result, when each leg is mounted in its respective bracket, it is placed under tension due to the stressing of the leg to bring portions 29*a*, 29*b* into the same plane. More specifically, a force couple is produced. When the leg is extended, this stress tends to urge the leg outwardly or counterclockwise as viewed in FIGS. 4 and 7 bringing portions 26*a*, 26*b* into engagement with the underside of bracket 22. However, when the leg is folded inwardly, it moves across an axis between the portions 29*a*, 29*b* so that the stress tends to urge the leg inwardly or clockwise as viewed in FIGS. 4 and 7 bringing it into the broken line position shown in FIG. 7 or the solid line position shown in FIG. 8 yieldingly urging portion 28 against the underside of mat 19.

In this fashion, the frame is supported at points beyond the periphery of the frame 11 providing a stable jogging surface.

Figure 8:
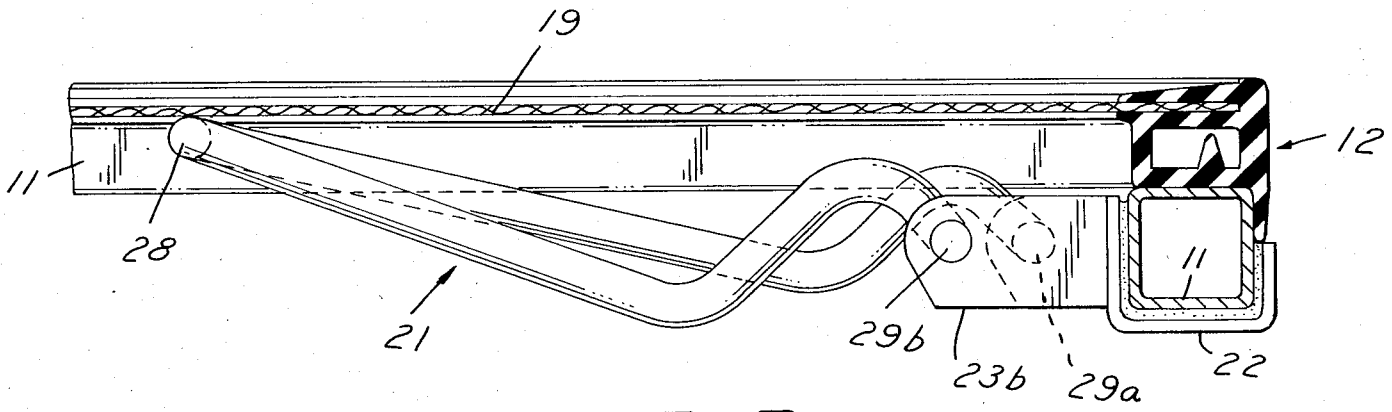
FIG. 8 is a fragmentary sectional view similar to FIG. 4 showing the leg in folded position.

In order to facilitate shipment or storage by making the package small, the legs 21 can be folded inwardly within the plane of the jogging apparatus as shown in FIG. 8.

In use, the legs 21 are extended and the jogging apparatus is placed on a floor. The resilience of the spring legs and the layer 21a permit sufficient resiliency to accommodate lack of flatness in the floor. As a result, the jogging apparatus will not rock or be unstable even before user steps on mat 19.

What is claimed is:

1. A jogging apparatus comprising an annular frame defining an opening, an elastomeric annular body bonded to said frame, a mat bonded to said elastomeric body and covering the opening in said frame such that the mat is yieldingly supported on said frame, said elastomeric body being hollow in cross section and comprises a top wall, a bottom wall and inner and outer side walls, said elastomeric body, in the unloaded and undeformed state, assumes a configuration such that the inner wall and outer wall extend upwardly and outwardly and, in the deformed state with the mat attached to the top wall, assumes a configuration such that the inner wall and outer wall are deflected radially inwardly such that they are generally vertical and the mat is stretched such that the elastomeric body is self-sustaining and having a configuration such that it is free to deflect in shear deformation radially inwardly upon downward movement of the mat, and means for supporting said frame in spaced relation to a supporting surface.

2. The jogging apparatus set forth in claim 1 wherein said frame has a long and short axis.

3. The jogging apparatus set forth in claim 2 wherein said frame is tubular.

4. The jogging apparatus set forth in claim 1 wherein said elastomeric body is made of a resilient material having a durometer of 40 to 60 on the A scale.

5. The jogging apparatus set forth in claim 1 wherein said elastomeric body includes an integral portion overlying and bonded to the portion of the mat bonded to the elastomeric body.

6. The jogging apparatus set forth in claim 1 wherein said elastomeric body includes an integral inwardly and upwardly extending peripheral lip that extends from the area of juncture of the top wall and outer side wall when the body is in the unstressed condition and is bonded to the top of said mat.

7. The jogging apparatus set forth in claim 6 wherein said elastomeric body includes an integral upstanding annular bead extending upwardly from the bottom between the inner and outer side walls.

8. The jogging apparatus set forth in claim 6 wherein said elastomeric body includes an integral lip extending downwardly from the area of juncture of the bottom wall and outer side wall and bonded to the outer surface of said frame.

9. The jogging apparatus set forth in claim 1 wherein said means for supporting said frame comprises a plurality of circumferentially spaced legs and means for pivoting said legs to said frame such that they may be folded from a ground engaging position wherein they extend outwardly and downwardly to a position wherein they lie substantially within the frame.

10. The jogging apparatus set forth in claim 9 wherein each said leg includes a first portion extending downwardly, a second portion extending radially outwardly and a third portion extending radially outwardly and downwardly when the leg is in operative position, and means on said frame for pivoting said first portion to said frame about a generally horizontal axis lying substantially in the plane of said frame such that when the leg is in operative position, the second portion of said leg contacts the underside of said frame and said leg is pivotable by swinging movement inwardly generally into the plane of the frame.

11. The jogging apparatus set forth in claim 10 wherein said means for pivoting each said leg to said frame comprises a bracket, said bracket being mounted on said frame and having portions extending radially inwardly to which said first portion of said each said leg is pivoted.

12. The jogging apparatus set forth in claim 11 including a layer of resilient material interposed between said bracket and said frame.

13. The jogging apparatus set forth in claim 12 wherein said leg is made of spring material.

14. The jogging apparatus set forth in claim 11 wherein said leg comprises a rod bent in a generally U shape to form two leg portions, said first portion of said leg comprising the spaced free ends of said rod, said second portion of said leg comprising the adjacent portions of said leg, and said third portion of said leg comprising the spaced leg portions which are joined to one another at the surface contacting portion of the leg, said free ends of said rod having portions thereof extending generally horizontally in the plane of said frame.

15. The jogging apparatus set forth in claim 14 wherein each said leg is made of spring material, one of said second portions being of different length than the other second portion and one of said third portions being of different length than the other third portion, said bracket having openings in said radially inwardly extending portions into which the free ends of each said leg extend, the axes of said openings being displaced radially inwardly relative to one another and lying in the same horizontal plane such that the free end portions must be stressed to bring them into a plane generally parallel to the plane of said mat when mounted on said bracket such that when the leg extends outwardly, the second portions thereof are urged against the bracket and when the leg is folded inwardly, the surface contacting portion is urged against the underside of the mat.

16. The jogging apparatus set forth in claim 11 wherein said bracket partially surrounds said frame, said radially inwardly extending portions of said brackets comprising ear portions on said frame.

17. The jogging apparatus set forth in claim 10 wherein said means for pivoting each said leg is such that when the leg extends outwardly the second portions thereof are urged against the bracket and when the leg is folded inwardly, the surface contacting portion is urged against the underside of the mat.

18. A jogging apparatus comprising an annular frame defining an opening having a rectangular tubular cross section, an elastomeric body bonded to the top surface of said frame throughout the circumferential extent thereof, a mat bonded to said elastomeric body and covering the opening in said frame such that the mat is yieldingly supported on said frame, said elastomeric body being stressed radially inwardly by said mat such that said elastomeric body is deflected in shear deformation and the mat is tightly stretched, said elastomeric body being hollow in cross section and comprises a top wall, a bottom wall and inner and outer side walls, said elastomeric body, in the unloaded and undeformed state, assumes a configuration such that the inner wall and outer wall extend upwardly and outwardly and, in the deformed state with the mat attached to the top wall, assumes a configuration such that the inner wall and outer wall are deflected radially inwardly such that they are generally vertical and the mat is stretched such that the elastomeric body is self-sustaining and having a configuration such that it is free to deflect in shear deformation radially inwardly upon downward movement of the mat, and means for supporting said frame in spaced relation to a supporting surface.

19. The jogging apparatus set forth in claim 18 wherein said frame has a long and short axis.

20. The jogging apparatus set forth in claim 18 wherein said elastomeric body is made of a resilient material having a durometer of 40 to 60 on the A scale.

21. The jogging apparatus set forth in claim 18 wherein said elastomeric body includes an integral portion overlying and bonded to the portion of the mat bonded to the elastomeric body.

22. The jogging apparatus set forth in claim 18 wherein said elastomeric body includes an inwardly and upwardly extending peripheral lip that extends from the area of juncture of the top wall and outer side wall.

23. The jogging apparatus set forth in claim 22 wherein said elastomeric body includes an integral upstanding annular bead extending upwardly from the bottom wall between the inner and outer walls.

24. The jogging apparatus comprising a frame, a mat, means for supporting said mat on said frame, a plurality of circumferentially spaced legs, each said leg including a first portion extending downwardly, a second portion extending radially outwardly and a third portion extending radially outwardly and downwardly when the leg is in operative position, and means on said frame for pivoting said first portion to said frame about a generally horizontal axis lying substantially in the plane of said frame such that when the leg is in operative position, the second portion of said leg contacts the underside of said frame and said leg is pivotable by swinging movement inwardly generally into the plane of the frame, said means for pivoting each said leg to said frame comprising a bracket, said bracket being mounted on said frame and having ear portions extending radially inwardly to which said first portion of said frame is pivoted, each said leg comprising a rod bent in a generally U shape to form two leg portions, said first portion of said leg comprising the spaced free ends of said rod, said second portion of said leg comprising the adjacent portions of said leg, and said third portion of said leg comprising the spaced leg portions which are joined to one another at the surface contacting portions of the leg, said free ends of said rod having portions thereof extending generally horizontally in the plane of said frame, each said leg is made of spring material, one of said second portions being of different length than the other second portion and one of said third portions being of different length than the other third portion, said bracket having openings in said radially inwardly extending portions into which the free ends of each said leg extend, the axes of said openings being displaced radially inwardly relative to one another and lying in the same horizontal plane such that the free end portions must be stressed to bring them into a plane generally parallel to the plane of said mat when mounted on said bracket such that when the leg extends outwardly, the second portions thereof are urged against the bracket and when the leg is folded inwardly, the surface contacting portion is urged against the underside of the mat, said means for pivoting each said leg is such that when the leg extends outwardly, the second portions thereof are urged against the bracket and when the leg is folded inwardly, the surface contacting portion is urged against the underside of the mat.

* * * * *